US006104178A

United States Patent [19]

Sugimoto

[11] Patent Number: 6,104,178

[45] Date of Patent: Aug. 15, 2000

[54] DRIVE CIRCUIT FOR DRIVING AN INK JET HEAD

[75] Inventor: Tasuku Sugimoto, Nagoya, Japan

[73] Assignee: Brother Kogyo Kabushiki Kaisha, Nagoya, Japan

[21] Appl. No.: 09/016,933

[22] Filed: Feb. 2, 1998

[30] Foreign Application Priority Data

Feb. 10, 1997 [JP] Japan ..... 9-026737

[51] Int. Cl.[7] ..... G05F 3/16; B41J 29/38

[52] U.S. Cl. ..... 323/315; 347/14

[58] Field of Search ..... 323/312, 315; 347/9, 10, 14, 16, 19

[56] References Cited

U.S. PATENT DOCUMENTS

| | | | |
|---|---|---|---|
| 4,282,535 | 8/1981 | Kern et al. | 346/140 R |
| 5,736,997 | 4/1998 | Bolash et al. | 347/19 |
| 5,909,229 | 6/1999 | Moriguchi et al. | 347/13 |

*Primary Examiner*—Matthew Nguyen
*Attorney, Agent, or Firm*—Oliff & Berridge, PLC

[57] ABSTRACT

In the drive circuit for driving the ink jet head, the first current mirror circuit (constructed from the transistors Q3, Q6, Q9) and the first regulation circuit (including the variable resistor VR1) are arranged in the charging circuit 31, and the second current mirror circuit (constructed from the transistors Q14, Q16, Q18) and the second regulation circuit (including the variable resistor VR2) are arranged in the discharging circuit 32, thereby the voltage waveform (gradient) at the leading edge of the drive signal applied to the piezoelectric elements 12 in the head parts 30A, 30B is regulated since the current ratio between the current value at the source side and the current value at the output side of the first current mirror circuit is regulated by the first regulation circuit, and the voltage waveform (gradient) at the trailing edge of the drive signal applied to the piezoelectric elements 12 in the head parts 30A, 30B is regulated since the current ratio between the current value at the source side and the current value at the output side of the second current mirror circuit is regulated by the second regulation circuit.

23 Claims, 3 Drawing Sheets

DRIVE CIRCUIT FOR DRIVING AN INK JET HEAD

BACKGROUND OF THE INVENTION

1. Field of the Invention

The present invention relates to a drive circuit for driving an ink jet head installed on an ink jet printer, the ink jet head having a plurality of head parts in each of which piezoelectric elements are arranged corresponding to plural nozzle openings and ink droplets are ejected from the nozzle openings by applying a drive signal produced when charging and discharging of a condenser connected to the piezoelectric elements. In particular, the present invention relates to a drive circuit with a regulation circuit which is in common with each of the head parts, thereby a voltage waveform of the drive signal in each head part can be totally regulated by the regulation circuit, therefore it can easily realize multi-head part construction (multi-nozzle construction) in the ink jet head.

2. Description of Related Art

Conventionally, in an ink jet head of piezoelectric type in which piezoelectric elements are used as ink ejection means, a drive signal (drive voltage), which abruptly changes, is applied to the piezoelectric element arranged on a nozzle opening, thereby volume change occurs in the piezoelectric element and volume of an ink room filled with ink changes. Thus, various printings are conducted on a recording medium by ejecting ink droplets from the nozzle openings.

Here, the piezoelectric element is equivalent to a condenser (capacitance) taking into its electric characteristic, thus, if a voltage waveform of the drive signal applied to the piezoelectric element is made simply rectangular waveform, an input current to the piezoelectric element becomes large, as a result, there is a problem that the drive circuit will be broken. Taking the above circumstances into consideration, as the voltage waveform of the drive voltage to drive the piezoelectric element of the ink jet head, a trapezoid waveform or a triangle waveform of the drive voltage is used in the conventional ink jet head so as to make the input current to the piezoelectric element small. In case of that the voltage waveform of the drive voltage is made a trapezoid waveform or a triangle waveform, it is well-known that a gradient of the drive voltage affects an ink ejecting velocity and an ink ejecting quantity in the ink jet head, therefore it is necessary to control the gradient of the drive voltage.

In order to satisfy the above demand, it is used in the drive circuit of the ink jet head in the arts a regulation circuit to regulate a current value in a condenser (capacitance) and a constant-current circuit. Through the constant-current circuit, electric charge is charged in and discharged from the condenser, and the voltage waveform obtained by controlling the gradient of the drive voltage based on the current value of the constant-current circuit is produced. Further, after the voltage waveform is amplified by an amplifier the piezoelectric element is driven by the amplified voltage waveform.

However, in the above drive circuit of the ink jet head, if a plurality of head parts are installed in the ink jet head corresponding to color printing (in this case, a plurality of head parts are installed according to ink colors used for color printing and a plurality of nozzle openings and piezoelectric elements are formed in each head part), current flowing into the amplifier from the circuit producing the voltage waveform of the drive signal increases. Thereby, the voltage waveform changes differently from each other in a case that ink is ejected from the one head part and in another case that ink is ejected from the plural head parts.

To avoid the above cases, the condenser (capacitance), the constant-current circuit, the regulation circuit for regulating current in the constant-current circuit and the amplifier are constructed in one drive circuit unit. In this case, it is necessary to construct a plurality of drive circuit units in accordance to number of the head parts, and further it is necessary to regulate the voltage waveform of the drive signal every each drive circuit unit.

In case that it is necessary to stagger drive timing of the nozzle with a voluntary time every head part at the time of drive control of each head part, a plurality of drive circuit units should be inevitably used and the voltage waveform of the drive signal should be regulated every each drive circuit unit.

SUMMARY OF THE INVENTION

Accordingly, it is an object of the present invention to overcome the above mentioned problems and to provide a drive circuit of an ink jet head with a regulation circuit which is in common with each of head parts, thereby a voltage waveform of a drive signal in each head part can be totally regulated by the regulation circuit, therefore it can easily realize multi-head part construction (multi-nozzle construction) in the ink jet head.

Further, it is another object of the present invention to provide a drive circuit having a plurality of regulation circuits, each regulation circuit being selectively used, thereby the drive circuit can be easily applied for various printing forms.

To accomplish above objects, according to one aspect of the present invention, it is provided a drive circuit for driving an ink jet head having at least two head parts with a plurality of nozzle openings on each of which a piezoelectric element is arranged, ink being ejected from each nozzle opening when a drive signal with a voltage waveform is applied to the piezoelectric element, the drive circuit comprising:

- at least two condensers for applying the drive signal to the piezoelectric element, the condenser being arranged corresponding to each head part;
- a charging circuit connected to the condensers, the charging circuit charging the condensers based on a charging signal;
- a discharging circuit connected to the condensers, the discharging circuit discharging the condensers based on a discharging signal;
- a first current mirror circuit arranged in the charging circuit, the first current mirror circuit having a source side and an output side; and
- a first regulation circuit for changing a current ratio between a current value at the source side and a current value at the output side of the first current mirror circuit, thereby regulating the voltage waveform of the drive signal.

According to the drive circuit, when the charging signal is applied to the charging circuit, the condensers arranged corresponding to each head part are charged by the first current mirror circuit in the charging circuit. And when the discharging signal is applied to the discharging circuit, the condensers are discharged. In this way, the drive signal is applied to the piezoelectric elements of the ink jet head when the condensers are charged and discharged, thereby ink droplets are ejected from the nozzle openings and printing is conducted.

At that time, based on regulating state by the first regulation circuit, the voltage waveform (gradient) at the leading edge of the drive signal is determined according to charging characteristic of the condenser. Here, the first current mirror circuit makes the output current value to the condensers constant at the output side thereof and operates to proportion the current value at the source side thereof to the above output current value. Therefore, the current ratio between the current values at the source side and the output side of the first current mirror circuit is regulated by the first regulation circuit, thus it can be regulated the voltage waveform (gradient) at the leading edge of the drive signal applied to the piezoelectric elements in each head part. Thereby, the voltage waveform at the leading edge of the drive signal applied to the piezoelectric elements can be totally regulated by the only one common first regulation circuit, therefore it can easily realize multi-head part construction (multi-nozzle construction) in the ink jet head.

Here, among printing methods by the ink jet head, for instance, there exists a push-and-ejection type in which the piezoelectric elements are deformed by the drive signal when the condensers are charged and ink droplets are ejected from the nozzle openings, further ink is sucked in ink rooms when the condensers are discharged. In the push-and-ejection type, the voltage waveform of the drive signal at charging of the condensers especially influences the ink ejecting velocity and the ink ejecting quantity. At this point, the above mentioned drive circuit can be suitably applied to the ink jet head of the push-and-ejection type, because the voltage waveform at the leading edge of the drive signal can be regulated by the first regulation circuit.

According to another aspect of the present invention, it is provided the drive circuit further comprising a second current mirror circuit arranged in the discharging circuit, the second current mirror circuit having a source side and an output side; and a second regulation circuit for changing a current ratio between a current value at the source side and a current value at the output side of the second current mirror circuit, thereby regulating the voltage waveform of the drive signal.

In the drive circuit, both the second current mirror circuit and the second regulation circuit are arranged in the discharging circuit, thereby the based on regulating state by the second regulation circuit, the voltage waveform (gradient) at the trailing edge of the drive signal is determined according to discharging characteristic of the condenser. Here, the second current mirror circuit makes the output current value to the condensers constant at the output side thereof and operates to proportion the current value at the source side thereof to the above output current value. Therefore, the current ratio between the current values at the source side and the output side of the second current mirror circuit is regulated by the second regulation circuit, thus it can be regulated the voltage waveform (gradient) at the trailing edge of the drive signal applied to the piezoelectric elements in each head part. Thereby, the voltage waveform at the trailing edge of the drive signal applied to the piezoelectric elements can be totally regulated by the only one common second regulation circuit, therefore it can easily realize multi-head part construction (multi-nozzle construction) in the ink jet head.

Here, among printing methods by the ink jet head, for instance, there exists a pull-and-ejection type in which the piezoelectric elements are deformed by the drive signal when the condensers are charged and ink is sucked in ink rooms, further ink droplets are ejected from the nozzle openings when the condensers are discharged. In the pull-and-ejection type, the voltage waveform of the drive signal at both charging and discharging of the condensers especially influences the ink ejecting velocity and the ink ejecting quantity. At this point, the above mentioned drive circuit can be suitably applied to the ink jet head of the pull-and-ejection type, because the voltage waveform at the leading edge and the trailing edge of the drive signal can be regulated by the first regulation circuit and the second regulation circuit.

According to further another aspect of the present invention, it is provided the drive circuit further comprising a third regulation circuit for changing a current ratio between a current value at the source side and a current value at the output side of the first current mirror circuit, thereby regulating the voltage waveform of the drive signal, the third regulation circuit being selectively used with the first regulation circuit: and a fourth regulation circuit for changing a current ratio between a current value at the source side and a current value at the output side of the second current mirror circuit, thereby regulating the voltage waveform of the drive signal, the fourth regulation circuit being selectively used with the second regulation circuit.

In the drive circuit, in addition to the first regulation circuit, it is arranged in the charging circuit the third regulation circuit which is selectively used with the first regulation circuit, and in addition to the second regulation circuit, it is arranged in the discharging circuit the fourth regulation circuit which is selectively used with the second regulation circuit. Thereby, it can be preset two kinds of the voltage waveforms (gradient) at both the leading edge and the trailing edge of the drive signal applied to the piezoelectric elements. Thereby, even if the ink jet printer with the ink jet head has two kinds of printing resolutions, it can flexibly correspond to each printing resolution by selectively using the regulation circuit, therefore the drive circuit can be easily applied for various printing forms.

According to further another aspect of the present invention, it is provided a drive circuit for driving an ink jet head having at least two head parts with a plurality of nozzle openings on each of which a piezoelectric element is arranged, ink being ejected from each nozzle opening when a drive signal with a voltage waveform is applied to the piezoelectric element, the drive circuit comprising:

at least two condensers for applying the drive signal to the piezoelectric element, the condenser being arranged corresponding to each head part;

a charging circuit connected to the condensers, the charging circuit charging the condensers based on a charging signal;

a discharging circuit connected to the condensers, the discharging circuit discharging the condensers based on a discharging signal;

a second current mirror circuit arranged in the discharging circuit, the second current mirror circuit having a source side and an output side; and a second regulation circuit for changing a current ratio between a current value at the source side and a current value at the output side of the second current mirror circuit, thereby regulating the voltage waveform of the drive signal.

In the drive circuit, when the charging signal is applied to the charging circuit, the condensers arranged corresponding to each head part are charged. And when the discharging signal is applied to the discharging circuit, the condensers are discharged by the second current mirror circuit in the discharging circuit. At that time, based on regulating state by the second regulation circuit, the voltage waveform (gradient) at the trailing edge of the drive signal is determined according to discharging characteristic of the condenser. Here, the second current mirror circuit makes the output current value to the condensers constant at the output side thereof and operates to proportion the current value at the source side thereof to the above output current value. Therefore, the current ratio between the current values at the source side and the output side of the second current mirror circuit is regulated by the second regulation circuit, thus it can be regulated the voltage waveform (gradient) at the trailing edge of the drive signal applied to the piezoelectric elements in each head part. Thereby, the voltage waveform at the trailing edge of the drive signal applied to the piezoelectric elements can be totally regulated by the only one common second regulation circuit, therefore it can easily realize multi-head part construction (multi-nozzle construction) in the ink jet head.

Here, in the pull-and-ejection type mentioned above, the voltage waveform of the drive signal at discharging of the condensers especially influences the ink ejecting velocity and the ink ejecting quantity. At this point, the above mentioned drive circuit can be suitably applied to the ink jet head of the pull-and-ejection type, because the voltage waveform at the trailing edge of the drive signal can be regulated by the second regulation circuit.

The above and further objects and novel features of the invention will more fully appear from the following detailed description when the same is read in connection with the accompanying drawings. It is to be expressly understood, however, that the drawings are for purpose of illustration only and not intended as a definition of the limits of the invention.

BRIEF DESCRIPTION OF THE DRAWINGS

The invention will be described with reference to the accompanying drawings, wherein.

DETAILED DESCRIPTION OF THE PREFERRED EMBODIMENTS

A detailed description of embodiments embodying the present invention will be given referring to the accompany drawings. First, a control system of an ink jet printer on which an ink jet head is installed will be described according to FIG. 1.

Figure 1:
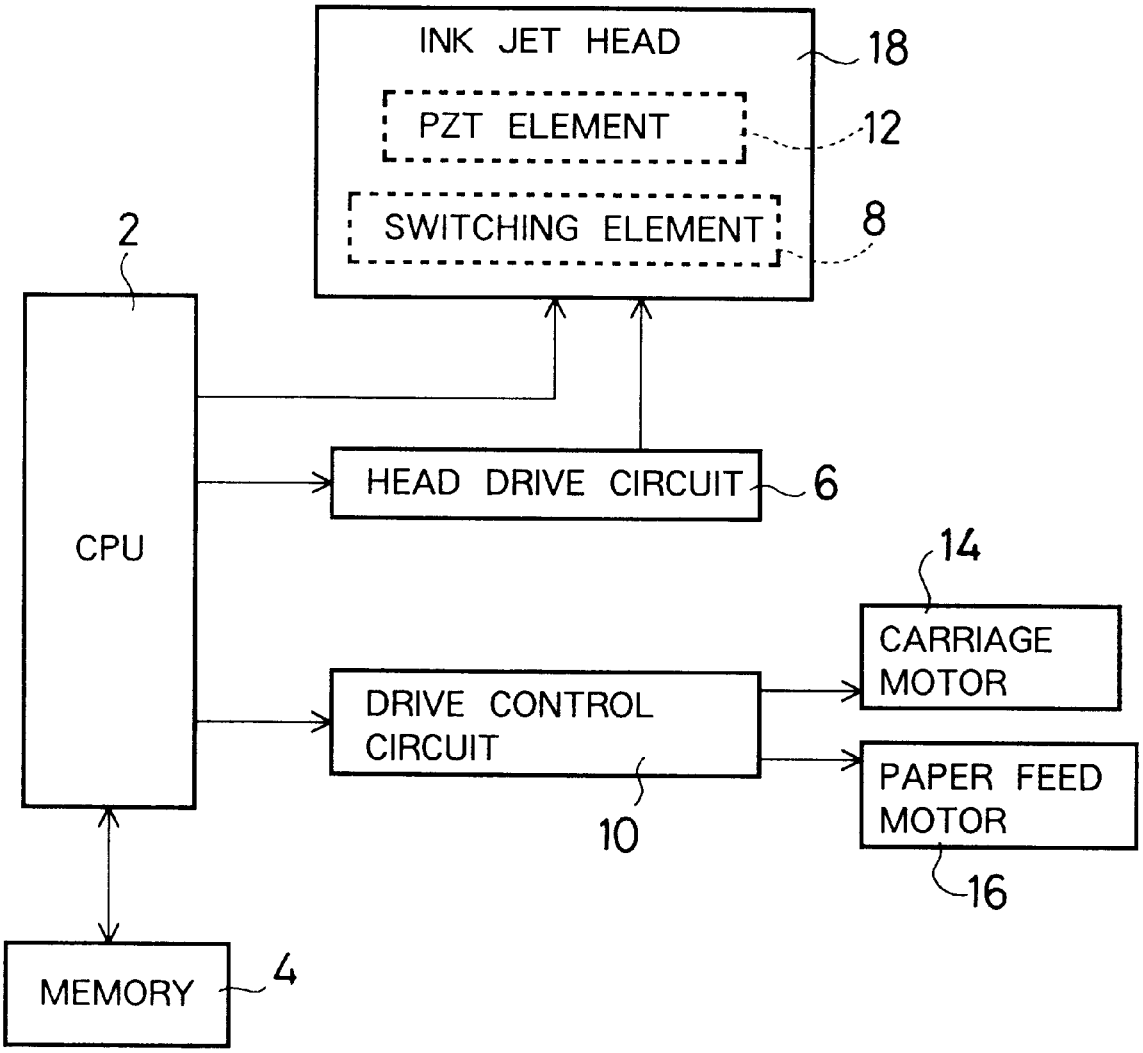
FIG. 1 is a block diagram schematically indicating a control system of an ink jet printer.

In FIG. 1, the control system of the ink jet printer is mainly constructed from a CPU 2. The CPU 2 controls to drive a switching element 8 in the ink jet head 18, a head drive circuit 6 and a drive control circuit 10, based on programs stored in a memory 4.

Figure 2:
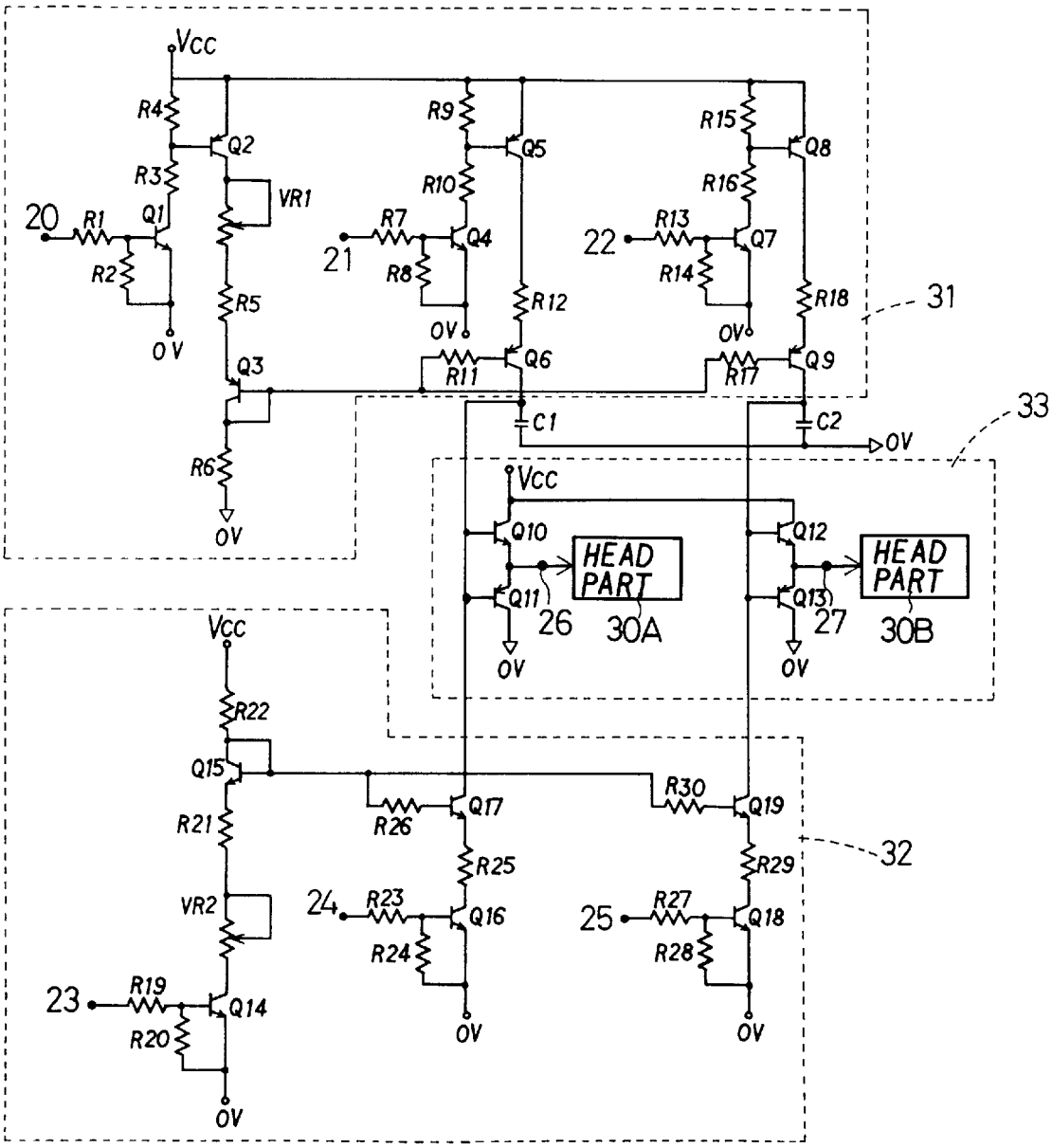
FIG. 2 is a circuit diagram of a drive circuit according to the first embodiment.
Figure 3:
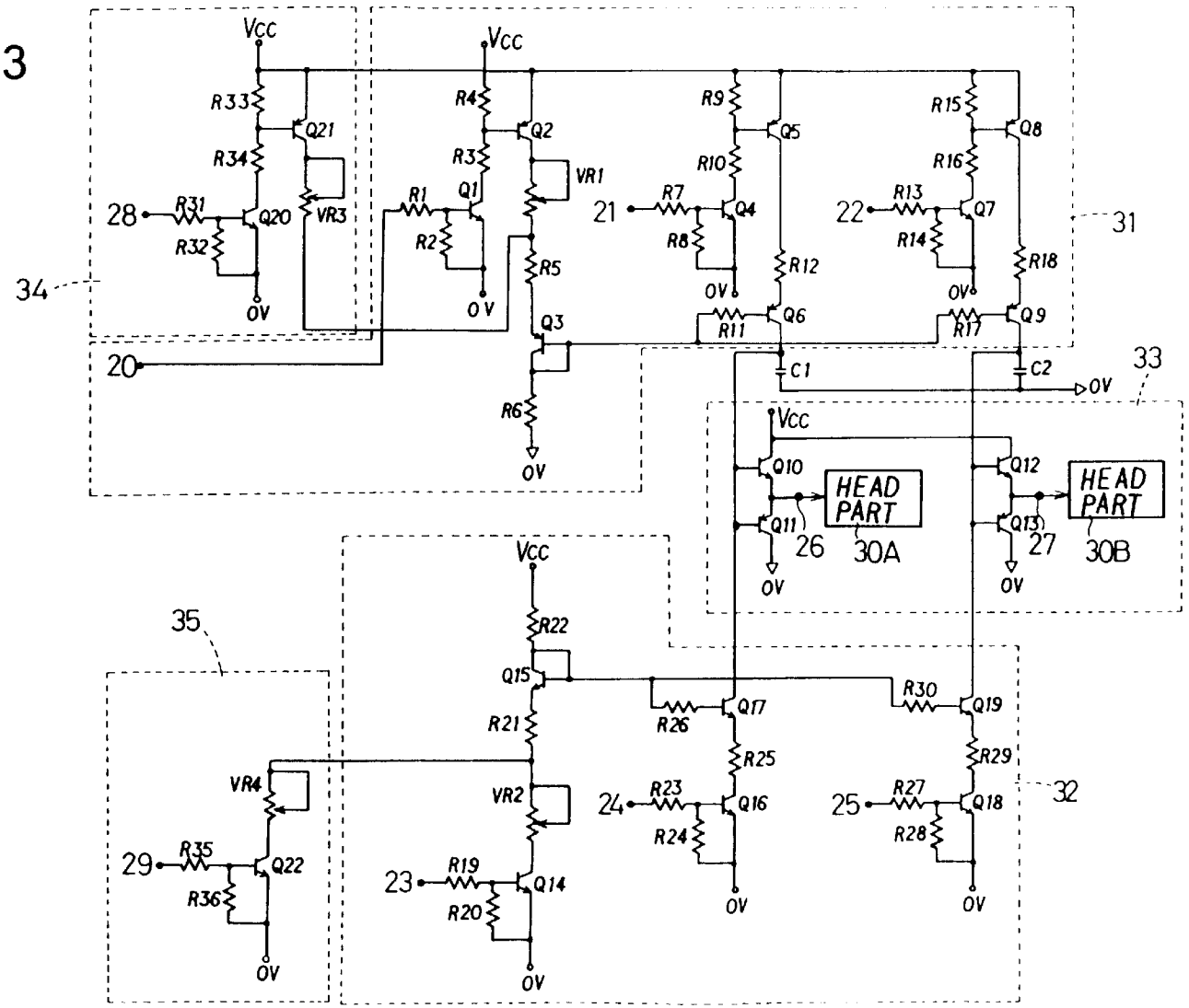
FIG. 3 is a circuit diagram of a drive circuit according to the second embodiment.

The ink jet head 18 has a plurality of head parts 30A, etc. as shown in FIGS. 2, 3. Each head part has a plurality of piezoelectric elements 12 and nozzle openings (not shown), each piezoelectric element 12 being arranged on each nozzle opening. The switching element 8 connected to each piezoelectric element 12 is an analog switch and acts to selectively connect the head drive circuit 6 and the piezoelectric element 12 according to control signal output from the CPU 2. Here, the ink jet head 18 is a head capable of full-color printing by using four color inks (black ink, magenta ink, yellow ink and cyan ink), and has four head parts (in FIG. 2, two head parts 30A and 30B are shown) corresponding to four colors of inks.

The head drive circuit 6 outputs a drive signal to drive the piezoelectric elements 12 based on various control signals from the CPU 2. The drive signal is applied to the piezoelectric elements 12 in the head part 30A, 30B through the switching element 8, thereby printing is variously conducted when ink droplets are ejected onto a print medium from the nozzle openings. A detailed description of the head drive circuit 6 will be described hereinafter.

The drive control circuit 10 drives a carriage motor 14 and a paper feed motor 16 in accordance with control signals output from the CPU 2. Here, the carriage motor 14 moves the ink jet head 18 arranged on a carriage through a timing belt, and the paper feed motor 16 feeds print medium (sheet) through a belt, a rotating shaft and rollers, etc.

Hereinafter, the head drive circuit 6 according to the first embodiment will be described with reference to FIG. 2. In FIG. 2, the head drive circuit 6 is roughly constructed from a charging circuit 31, a discharging circuit 32, a current amplifying circuit 33 and condensers C1, C2 connected between the charging circuit 31 and the current amplifying circuit 33. In the head drive circuit 6, Q8, Q9, Q11 and Q13 are PNP transistors, and Q1, Q4, Q7, Q10, Q12, Q14, Q15, Q16, Q17, Q18 and Q19 are NPN transistors. R1–R30 are resistors. VR1 and VR2 are variable resistors. C1 and C2 are condensers.

A charging signal input terminal is indicated by a numeral 20. To the charging signal input terminal 20, a charging signal is input when the condensers C1, C2 are charged by the charging circuit 31. Control signal input terminals are indicated by numerals 21 and 22. To the control signal input terminals 21, 22, control signals are selectively input from the CPU 2 when each head part 30A, 30B is independently driven. For instance, when the head part 30A is driven, control signal is input to the control signal input terminal 21, thereby the condenser C1 is charged. A discharging signal input terminal is indicated by a numeral 23. To the discharging signal input terminal 23, a discharging signal is input when the condensers C1, C2 are discharged by the discharging circuit 32. Control signal input terminals are indicated by numerals 24, 25. To the control signal input terminals 24, 25, control signals are selectively input from the CPU 2 when the condensers C1, C2 are discharged to independently drive each head part 30A, 30B. For instance, when the condenser C1 is discharged, control signal is input to the control signal input terminal 24, thereby the condenser C1 is discharged. Output terminals 26, 27 corresponds to the head part 30A and 30B, respectively. Drive signals are output to each head part 30A, 30B from the output terminals 26, 27, respectively.

In the charging circuit 31, PNP transistors Q3, Q6, Q9 construct the so-called first current mirror circuit. PNP transistor Q3 acts as a source side, PNP transistors Q6, Q9 act as output sides. Here, NPN transistor Q1 and PNP transistor Q2 are used for switching PNP transistor Q3 ON/OFF based on the charging signal from the charging signal input terminal 20. NPN transistor Q4 and PNP transistor Q5 are used for switching NPN transistor Q6 ON/OFF based on the control signal from the control input terminal 21. NPN transistor Q7 and PNP transistor Q8 are used for switching PNP transistor Q9 ON/OFF based on the control signal from the control signal input terminal 22.

The resistor R6 restricts current flowing from the emitter to the collector and base in PNP transistor Q3. The variable resistor VR1 is used for regulating a current ratio between the current flowing in the resistor R6 and the current flowing to the collectors of PNP transistors Q6, Q9. The variable resistor VR1, the resistor R6, PNP transistors Q6, Q8 construct the first regulation circuit.

In the discharging circuit 32, NPN transistors Q15, Q17 and Q19 construct the second current mirror circuit. NPN transistor Q15 acts as a source side and NPN transistors Q17, Q19 act as output sides. Here, NPN transistor Q14 is used for switching NPN transistor Q15 ON/OFF based on the discharging signal from the discharging signal input terminal 23. NPN transistor Q16 is used for switching NPN transistor Q17 ON/OFF based on the control signal from the control input terminal 24. NPN transistor Q18 is used for switching NPN transistor Q19 ON/OFF based on the control signal from the control signal input terminal 25.

The resistor R22 restricts current flowing from the emitter to the collector and base in NPN transistor Q15. The variable resistor VR2 is used for regulating a current ratio between the current flowing in the resistor R22 and the current flowing to the collectors of NPN transistors Q17, Q19. The variable resistor VR2, the resistor R22, NPN, transistors Q17, Q19 construct the second regulation circuit.

The condenser C1 produces the voltage waveform of the drive signal by being charged through PNP transistor Q6 and discharged through NPN transistor Q17. Similarly, the condenser C2 produces the voltage waveform of the drive signal by being charged through PNP transistor Q9 and discharged through NPN transistor Q19.

In the current amplifying circuit 33, PNP transistor Q11 and NPN transistor Q10 construct the push-pull circuit, and conducts current amplifying of the drive signal having the voltage waveform produced by the condenser C1. Similarly, PNP transistor Q13 and NPN transistor Q12 construct the push-pull circuit, and conducts current amplifying of the drive signal having the voltage waveform produced by the condenser C2.

Here, the resistors R5, R12, R18, R21, R25 and R29 act for restricting dispersion of the current ratio at output sides of the first and second current mirror circuits, due to quality dispersion of the transistors constructing the first and second current mirror circuit. The resistor R11 restricts the base current of the PNP transistor Q6 when saturated, and the resistor R17 restricts the base current of PNP transistor Q9 when saturated. The resistor R26 restricts the base current of NPN transistor Q17 when saturated, and the resistor R30 restricts the base current of NPN transistor Q19 when saturated.

Hereinafter, operation of the above constructed head drive circuit 6 will be described. First, when the head part 30A is driven, the charging signal is input through the charging signal input terminal 20, thereby NPN transistor Q1 is turned ON and PNP transistor Q2 is turned ON. Thus, current restricted by the resistors R5, R6 and the variable resistor VR1 flows from the emitter to the base and collector in PNP transistor Q3. Similarly, when the discharging signal is input through the discharging input terminal 23, NPN transistor Q14 is turned ON, thus current restricted by the resistors R21, R22 and the variable resistor VR2 flows from the base and collector to the emitter in NPN transistor Q15. Continuously, the control signal is input through the control signal input terminal 21, thereby NPN transistor Q4 is turned ON and PNP transistor Q5 is turned ON. Thus, current in proportion to the current flowing to the resistor R6 according to the current ratio regulated by the variable resistor VR1 flows to the collector of PNP transistor Q6. Therefore, the condenser C1 is charged. And when potential of the condenser C1 is raised up and PNP transistor Q6 is saturated, charging of the condenser C1 is terminated. Further, when inputting of the control signal to the control signal input terminal 21 stops, NPN transistor Q4 is turned OFF and PNP transistor Q5 is turned OFF, thereby current does not flow to PNP transistor Q6.

When the control signal is input through the control signal input terminal 24, NPN transistor Q16 is turned ON and current in proportion to the current flowing to the resistor R22 according to the current ratio regulated by the variable resistor VR2 flows to the collector of NPN transistor Q17. Thereby, the condenser C1 is discharged. And when potential of the condenser C1 goes down and NPN transistor Q17 is saturated, discharging of the condenser C1 is terminated. Further, when inputting of the control signal to the control signal input terminal 24 stops, NPN transistor Q16 is turned OFF, thereby current does not flow to NPN transistor Q17.

According to charging and discharging operation of the condenser C1, the drive signal with trapezoid voltage waveform is produced in the condenser C1, and such drive signal is amplified by the current amplifying circuit constructed from PNP transistor Q11 and NPN transistor Q1O, and thereafter is output to the head part 30A through the output terminal 26.

At that time, in the trapezoid voltage waveform of the drive signal, the gradient of voltage at the leading edge of drive signal is set according to charging characteristic to the condenser C1, on the basis of regulating condition by the variable resistor VR1. Similarly, the gradient of voltage at the trailing edge of the drive signal is set according to discharging characteristic from the condenser C1, on the basis of regulating condition by the variable resistor VR2.

Hereinafter, operation of the head drive circuit 6 will be described in a case that the head part 30B is driven. Similarly to the above case, when the control signal is input through the control signal input terminal 22, NPN transistor Q7 is turned ON and PNP transistor Q8 is turned ON. Thus, current in proportion to the current flowing to the resistor R6 according to the current ratio regulated by the variable resistor VR1 flows to the collector of PNP transistor Q9. Therefore, the condenser C2 is charged. And when potential of the condenser C2 is raised up and PNP transistor Q9 is saturated, charging of the condenser C2 is terminated. Further, when inputting of the control signal to the control signal input terminal 22 stops, NPN transistor Q7 is turned OFF and PNP transistor Q8 is turned OFF, thereby current does not flow to PNP transistor Q9.

When the control signal is input through the control signal input terminal 25, NPN transistor Q18 is turned ON and current in proportion to the current flowing to the resistor R22 according to the current ratio regulated by the variable resistor VR2 flows to the collector of NPN transistor Q19. Thereby, the condenser C2 is discharged. And when potential of the condenser C2 goes down and NPN transistor Q19 is saturated, discharging of the condenser C2 is terminated. Further, when inputting of the control signal to the control signal input terminal 25 stops, NPN transistor Q18 is turned OFF, thereby current does not flow to NPN transistor Q19.

According to charging and discharging operation of the condenser C2, the drive signal with trapezoid voltage waveform is produced in the condenser C2, and such drive signal is amplified by the current amplifying circuit constructed from PNP transistor Q13 and NPN transistor Q12, and thereafter is output to the head part 30B through the output terminal 27.

At that time, in the trapezoid voltage waveform of the drive signal, the gradient of voltage at the leading edge of drive signal is set according to charging characteristic to the condenser C2, on the basis of regulating condition by the variable resistor VR1. Similarly, the gradient of voltage at the trailing edge of the drive signal is set according to discharging characteristic from the condenser C2, on the basis of regulating condition by the variable resistor VR2.

The drive signals output from the output terminals 26, 27 are applied to the piezoelectric elements 12 selected by the switching elements 8 under control of the CPU 2, thereby ink droplets are ejected from the nozzle openings and desirable printing is conducted on the print paper.

As mentioned above, in the head drive circuit 6 of the first embodiment, the first current mirror circuit (constructed from the transistors Q3, Q6 and Q9) in the charging circuit 31 controls the output current value to the condensers C1, C2 at the output side so as to become the same value, and controls the output current so as to proportion to the current value at the source side. Further, similarly to the first current mirror circuit, the second current mirror circuit (constructed from the transistors Q15, Q17 and Q19) in the discharging circuit 32 controls the output current value to the condensers C1, C2 at the output side so as to become the same value, and controls the output current so as to proportion to the current value at the source side.

Therefore, it can be regulated the voltage waveform (gradient) at the leading edge of the drive signal applied to the piezoelectric elements 12 in the plural head parts 30A, 30B, by regulating the current ratio between the current values at the source side and at the output side in the first current mirror circuit through the first regulation circuit constructed from the variable resistor VR1, etc. And it can be regulated the voltage waveform (gradient) at the trailing edge of the drive signal applied to the piezoelectric elements 12 in the plural head parts 30A, 30B, by regulating the current ratio between the current values at the source side and at the output side in the second current mirror circuit through the second regulation circuit constructed from the variable resistor VR2, etc.

Thus, through the only one first regulation circuit which is arranged commonly in the charging circuit 31, the voltage waveform at the leading edge of the drive signal applied to the piezoelectric elements 12 in each head part 30A, 30B can be totally regulated, and through the only one second regulation circuit which is arranged commonly in the discharging circuit 32, the voltage waveform at the trailing edge of the drive signal applied to the piezoelectric elements 12 in each head part 30A, 30B can be totally regulated. As s result, it can easily realize multi-head part construction (multi-nozzle construction) in the ink jet head 18.

And in the head drive circuit 6 of the first embodiment, since the voltage waveform at the leading edge of the drive signal applied to the piezoelectric elements 12 in each head part 30A, 30B can be totally regulated through the first regulation circuit, the head drive circuit 6 can be at least suitably applied for the ink jet head 18 of push-and-ejection type in which the piezoelectric elements 12 are deformed by the drive signal when the condensers C1, C2 are charged and ink droplets are ejected from the nozzle openings, further ink is sucked in the ink rooms when the condensers C1, C2 are discharged.

Further, since the voltage waveform at the trailing edge of the drive signal applied to the piezoelectric elements 12 in each head part 30A, 30B can be totally regulated through the second regulation circuit, the head drive circuit 6 can be at least suitably applied for the ink jet head 18 of pull-and-ejection type in which the piezoelectric elements 12 are deformed by the drive signal when the condensers C1, C2 are charged and ink is sucked in the ink rooms, further ink droplets are ejected from the nozzle openings when the condensers C1, C2 are discharged.

Furthermore, since the voltage waveform at both the leading edge and trailing edge of the drive signal applied to the piezoelectric elements 12 in each head part 30A, 30B can be also totally regulated through the first and second regulation circuits, the head drive circuit 6 can be suitably applied for the ink jet head 18 of both push-and-ejection type and pull-and-ejection type.

Since the control signal can be independently input to each control signal input terminal 21, 22, the drive signal output from each output terminal 26, 27 can be produced while staggering with voluntary time.

Hereinafter, the head drive circuit according to the second embodiment will be described with reference to FIG. 3. Here, the head drive circuit of the second embodiment has basically the same construction of the head drive circuit 6 in the first embodiment and is different from the head drive circuit 6 at points that there are provided in the charging circuit 31 a plurality of regulation circuits for regulating the current ratio between the current value at the source side and the current value at the output side in the first current mirror circuit and in the discharging circuit 32 a plurality of regulation circuits for regulating the current ratio between the current value at the source side and the current value at the output side in the second current mirror circuit. Remaining construction of the second embodiment is as same as the head drive circuit 6 in the first embodiment. Thus, hereinafter it will be described only the different construction from the first embodiment and the same elements as in the first embodiment will be indicated by the same numerals as in the first embodiment.

Referring to FIG. 3, the charging circuit 31 has the third regulation circuit 34 in addition to the first regulation circuit (constructed from the variable resistor VR1, etc.), and the discharging circuit 32 has the fourth regulation circuit 35 in addition to the second regulation circuit (constructed form variable resistor VR2, etc.).

In the third regulation circuit 34, R31–R34 are resistors, VR3 is a variable resistor, Q20 is a NPN transistor and Q21 is a PNP transistor. Numeral 28 indicates a charging signal input terminal and this charging signal input terminal 28 is selectively used with the charging signal input terminal 20. In the fourth regulation circuit 35, R35 and R36 are resistors, VR4 is a variable resistor and Q22 is a NPN transistor. Numeral 29 indicates a discharging signal input terminal and this discharging signal input terminal is selectively used with the discharging signal input terminal 23. Remaining construction is as same as in the head drive circuit 6 of the first embodiment.

Hereinafter, operation of the head drive circuit 6 of the second embodiment will be described. Here, as mentioned above, when both the charging signal and discharging signal are input through the charging signal input terminal 20, the discharging signal input terminal 23, the same operation as in the first embodiment is conducted. That is, it is produced the drive signal having the trapezoid voltage waveform obtained according to the current ratio regulated by the variable resistors VR1, VR2, Thus, explanation of such operation will be omitted.

After the same operation mentioned above, inputting of the charging signal and discharging signal to the charging signal input terminal 20, the discharging signal input terminal 23 is terminated, thereby NPN transistors Q1, Q14 and PNP transistor Q2 are turned OFF. Thereafter, when the charging signal is input to through the charging signal input terminal 28, NPN transistor Q20 is turned ON and PNP transistor Q21 is turned ON. Thereby, current restricted by the resistors R5, R6 and the variable resistor VR3 flows from the emitter to the base and collector in PNP transistor Q3.

Similarly, when the discharging signal is input through the discharging signal input terminal 29, NPN transistor Q22 is turned ON and current restricted by the resistors R21, R22 and the variable resistor VR4 flows from the base and collector to the emitter in NPN transistor Q15. Thereafter, the same operation in the first embodiment is conducted and current in proportion to the current flowing in the resistor R6 according to the current ratio regulated by the variable resistor VR3 flows to the collectors of PNP transistors Q6, Q9. Thereby, the condensers C1 and C2 are charged. Similarly, current in proportion to the current flowing in the resistor R22 according to the current ratio regulated by the variable resistor VR4 flows to the collectors of NPN transistors Q17, Q19. Thereby, the condensers C1, C2 are discharged. Based on this discharging operation, the drive signal having trapezoid voltage waveform to drive the ink jet head 18 produces in the condensers C1, C2. And such drive signal is amplified by the current amplifying circuit constructed from PNP transistors Q11, Q13 and NPN transistors Q10, Q12, and thereafter is output to the head parts 30A, 30B through the output terminals 26, 27.

As mentioned above, in the head drive circuit 6 of the second embodiment, it is provided in the charging circuit 31 the third regulation circuit 34 selectively used with the first regulation circuit, in addition the first regulation circuit, and in the discharging circuit 32 the fourth regulation circuit 35 selectively used with the second regulation circuit, in addition to the second regulation circuit. Therefore, it can be respectively preset two kinds of the voltage waveforms (gradient) at both the leading edge and the trailing edge of the drive signal applied to the piezoelectric elements 12 of the head parts 30A, 30B. Thus, even if the ink jet printer having the ink jet head 18 has two printing resolutions (for example, 300 dpi and 600 dpi), the head drive circuit 6 can flexibly correspond according to each printing resolution by selectively using each regulation circuit, as a result, the head drive circuit 6 can be easily applied for various printing forms.

While the invention has been particularly shown and described with reference to preferred embodiments thereof, it will be understood by those skilled in the art that the foregoing and other changes in form and details can be made therein without departing from the spirit and scope of the invention. For example, since the third and fourth regulation circuits 34, 35 are added in the second embodiment, it is conceivable to add further the fifth and sixth regulation circuits.

What is claimed is:

1. A drive circuit for driving an ink jet head having at least two head parts with a plurality of nozzle openings on each of which a piezoelectric element is arranged, ink being ejected from each nozzle opening when a drive signal with a voltage waveform is applied to the piezoelectric element, the drive circuit comprising:

at least two condensers for applying the drive signal to the piezoelectric element, the condenser being arranged corresponding to each head part;

a charging circuit connected to the condensers, the charging circuit charging the condensers based on a charging signal;

a discharging circuit connected to the condensers, the discharging circuit discharging the condensers based on a discharging signal;

a first current mirror circuit arranged in the charging circuit, the first current mirror circuit having a source side and an output side; and a first regulation circuit for changing a current ratio between a current value at the source side and a current value at the output side of the first current mirror circuit, thereby regulating the voltage waveform of the drive signal.

2. The drive circuit according to claim 1, further comprising:

a second current mirror circuit arranged in the discharging circuit, the second current mirror circuit having a source side and an output side; and a second regulation circuit for changing a current ratio between a current value at the source side and a current value at the output side of the second current mirror circuit, thereby regulating the voltage waveform of the drive signal.

3. The drive circuit according to claim 1, wherein the first regulation circuit includes a variable resistor therein.

4. The drive circuit according to claim 2, wherein the second regulation circuit includes a variable resistor therein.

5. The drive circuit according to claim 1, wherein the first current mirror circuit is constructed from at least three transistors.

6. The drive circuit according to claim 5, wherein one of the transistors is positioned at the source side and other two transistors are positioned at the output side.

7. The drive circuit according to claim 5, wherein the transistors are PNP transistors.

8. The drive circuit according to claim 2, wherein the second current mirror circuit is constructed from at least three transistors.

9. The drive circuit according to claim 8, wherein one of the transistors is positioned at the source side and other two transistors are positioned at the output side.

10. The drive circuit according to claim 8, wherein the transistors are NPN transistors.

11. The drive circuit according to claim 1, further comprising a current amplifying circuit for amplifying the drive signal.

12. The drive circuit according to claim 11, wherein the current amplifying circuit comprises a push-pull circuit.

13. The drive circuit according to claim 2, wherein the voltage waveform of the drive signal becomes a trapezoid waveform with a leading edge and a trailing edge by the first regulation circuit and the second regulation circuit.

14. The drive circuit according to claim 13, wherein the first regulation circuit regulates the voltage waveform at the leading edge thereof based on a charging characteristic of the condenser.

15. The drive circuit according to claim 13, wherein the second regulation circuit regulates the voltage waveform at the trailing edge thereof based on a discharging characteristic of the condenser.

16. The drive circuit according to claim 2, further comprising:

a third regulation circuit for changing a current ratio between a current value at the source side and a current value at the output side of the first current mirror circuit, thereby regulating the voltage waveform of the drive signal, the third regulation circuit being selectively used with the first regulation circuit; and a fourth regulation circuit for changing a current ratio between a current value at the source side and a current value at the output side of the second current mirror circuit, thereby regulating the voltage waveform of the drive signal, the fourth regulation circuit being selectively used with the second regulation circuit.

17. The drive circuit according to claim 16, wherein the third regulation circuit includes a variable resistor therein.

18. The drive circuit according to claim 16, wherein the fourth regulation circuit includes a variable resistor therein.

19. A drive circuit for driving an ink jet head having at least two head parts with a plurality of nozzle openings on each of which a piezoelectric element is arranged, ink being ejected from each nozzle opening when a drive signal with a voltage waveform is applied to the piezoelectric element, the drive circuit comprising:

at least two condensers for applying the drive signal to the piezoelectric element, the condenser being arranged corresponding to each head part;

a charging circuit connected to the condensers, the charging circuit charging the condensers based on a charging signal;

a discharging circuit connected to the condensers, the discharging circuit discharging the condensers based on a discharging signal;

a current mirror circuit arranged in the discharging circuit, the current mirror circuit having a source side and an output side; and a regulation circuit for changing a current ratio between a current value at the source side and a current value at the output side of the current mirror circuit, thereby regulating the voltage waveform of the drive signal.

20. The drive circuit according to 19, wherein the regulation circuit includes a variable resistor therein.

21. The drive circuit according to claim 19, wherein the current mirror circuit is constructed from at least three transistors.

22. The drive circuit according to claim 21, wherein one of the transistors is positioned at the source side and other two transistors are positioned at the output side.

23. The drive circuit according to claim 21, wherein the transistors are NPN transistors.

* * * * *